US006720972B2

(12) United States Patent
Feintuch

(10) Patent No.: US 6,720,972 B2
(45) Date of Patent: Apr. 13, 2004

(54) METHOD AND APPARATUS FOR REMAPPING SUBPIXELS FOR A COLOR DISPLAY

(75) Inventor: Martin W. Feintuch, Washington Township, Bergen County, NJ (US)

(73) Assignee: Honeywell International Inc., Morristown, NJ (US)

( * ) Notice: Subject to any disclaimer, the term of this patent is extended or adjusted under 35 U.S.C. 154(b) by 537 days.

(21) Appl. No.: 09/795,809

(22) Filed: Feb. 28, 2001

(65) Prior Publication Data

US 2003/0128223 A1 Jul. 10, 2003

(51) Int. Cl.[7] ..... G09G 5/02

(52) U.S. Cl. ..... 345/589; 345/3.3; 345/660; 345/603

(58) Field of Search ..... 345/589, 595, 345/603, 694, 695, 698, 3.3, 660, 671; 348/453, 808

(56) References Cited

U.S. PATENT DOCUMENTS

| | | | | |
|---|---|---|---|---|
| 4,600,274 A | | 7/1986 | Morozumi | |
| 5,341,153 A | * | 8/1994 | Benzschawel et al. | 345/660 |
| 5,821,913 A | * | 10/1998 | Mamiya | 345/88 |
| 6,266,042 B1 | * | 7/2001 | Aratani | 345/660 |

FOREIGN PATENT DOCUMENTS

| | | |
|---|---|---|
| EP | 0 795 847 A1 | 9/1997 |
| WO | Wo 97/23861 | 7/1997 |

* cited by examiner

*Primary Examiner*—Matthew Luu

(57) ABSTRACT

A method and apparatus for remapping video images from a display processor, represented by a quad-subpixel digital data stream to a striped-subpixel color display using a processor including an intermediate pixel memory where the processor presents an intermediate digital data stream to a resizing engine.

22 Claims, 6 Drawing Sheets

METHOD AND APPARATUS FOR REMAPPING SUBPIXELS FOR A COLOR DISPLAY

FIELD OF INVENTION

The present invention relates to the field of color displays, and more specifically, to a method and apparatus for manipulating subpixels contained within a serial data stream to form a displayed image.

BACKGROUND OF THE INVENTION

In an aircraft, pilots obtain critical information from instruments that include color displays. Certain color displays use a quad subpixel arrangement while other displays use a striped subpixel arrangement.

A quad-subpixel display 100 is depicted in FIG. 1 and includes pixels 110, where each pixel is comprised on a red subpixel 111, a first green subpixel 112, a blue subpixel 113, and a second green subpixel 114. This type of display has been developed specifically for military applications where it is desirable to double the display resolution for monochrome operation such as during the display of night vision imagery.

FIG. 2 shows a striped-subpixel display 200 that includes pixels 210, where each pixel is comprised on a red subpixel 211, a green subpixel 212, and a blue subpixel 213. The striped-subpixel display is very similar to the Sony Trinitron® color television and has been developed extensively for commercial uses.

In the years following the Cold War, and especially during the present, commercial display technology has surpassed military display technology. For example, the typical laptop computer available commercially has a greater resolution along with an attendant higher number of pixels than many of the most advanced military displays in service.

A significant amount of aircraft specific graphics symbology, and more particularly military specific graphics symbology, has been developed and continues to be used on aircraft displays. One specific military unique display includes a quad-subpixel arrangement. It is desirable to replace this quad-subpixel display on certain aircraft with the newer striped-subpixel display. However, changing the software underlying to this graphic symbology usually entails a long and costly development process.

There is a need in the art for a hardware apparatus and method that can intercept a digital data stream intended for a quad-subpixel display and reformat it into a digital data stream suitable for a striped-subpixel color display without introducing a significant time delay into the resultant displayed image. Such an apparatus and method will allow the re-use of previously developed military symbology without software modification in an existing aircraft display processor.

SUMMARY OF THE INVENTION

I have discovered that it is possible to process a digital data stream intended for a quad-subpixel display, for example a serial digital stream, by padding extra data values to the serial digital stream in real time. The resulting intermediate digital stream containing pad data, if displayed, would show a distorted picture. However, I have further discovered that the distortion can be removed by use of a commercially available resizing engine.

My invention extracts color and intensity information, for each subpixel in a digital data stream, representing a quad-subpixel color image and processes and redirects this information into an intermediate pixel memory. Additional data values are interspersed between the input values to pad the intermediate pixel memory; for example, the odd input lines do not include an 'blue' sub pixel data. After processing, the intermediate pixel memory contains data that can be used as an input to a display resizing engine such as a Genesis® chip, which in turn provides a digital data stream output that is suitable to drive a striped subpixel display. Advantageously, my invention can resize an alternate bit map from the intermediate pixel memory in order to account for the potentially different quantity of pixels in the quad subpixel (m times n) versus the striped subpixel (x times y) display.

In one specific illustrative embodiment of my invention, the extra data values padded into the data stream have a zero value. In a second illustrative embodiment, the padded zero values are replaced with average intensity values.

DESCRIPTION OF THE INVENTION

Figure 1:
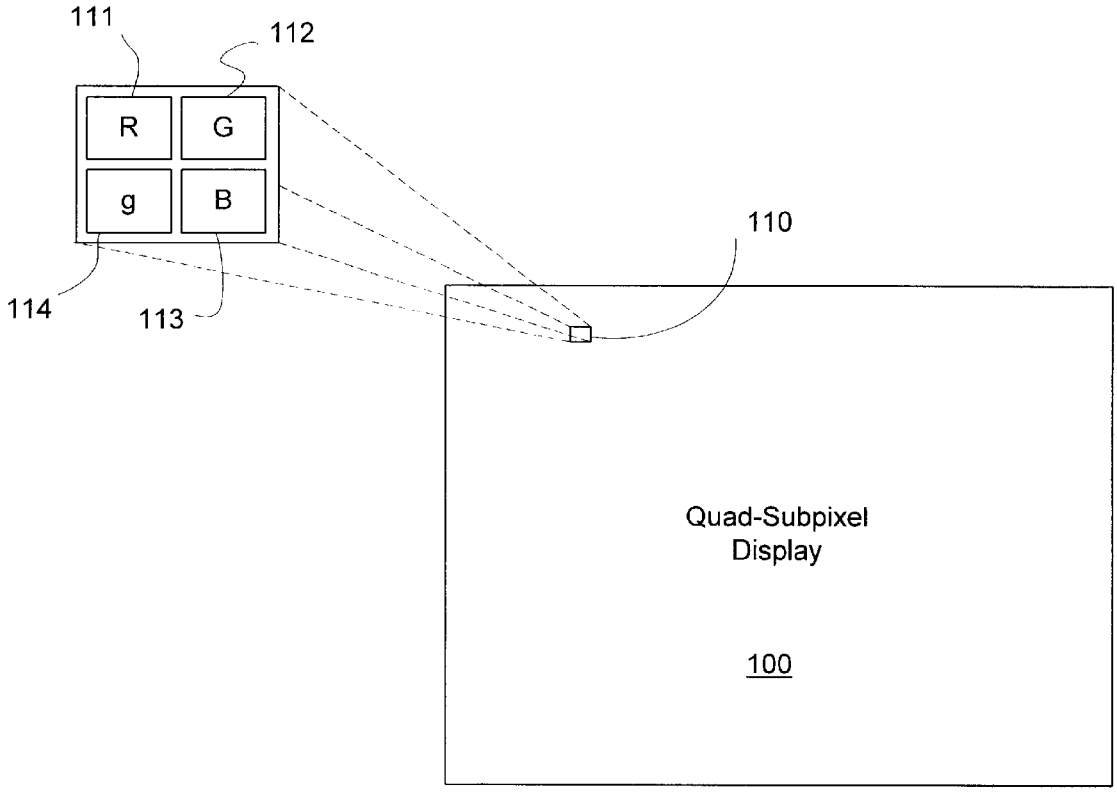
FIG. 1 (Prior Art)
FIG. 1 depicts a quad-subpixel display in accordance with the prior art.
Figure 2:
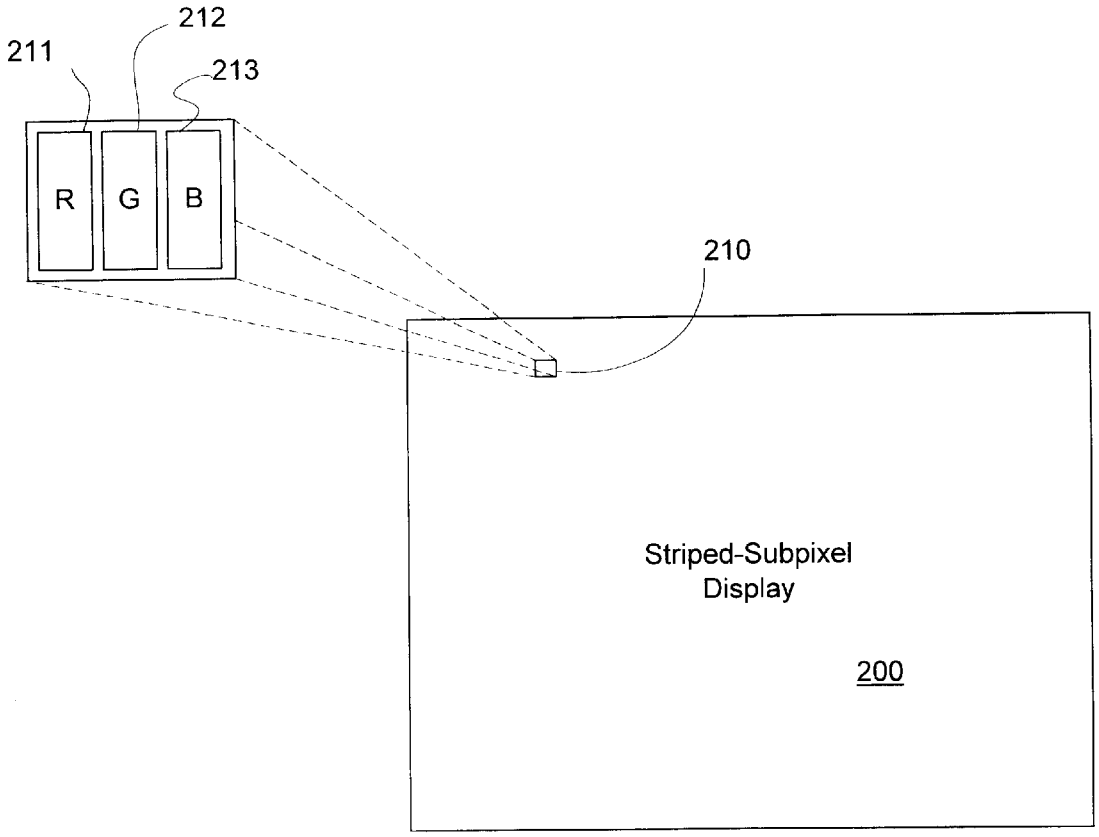
FIG. 2 (Prior Art)
FIG. 2 depicts a striped-subpixel color display in accordance with the prior art.
Figure 3:
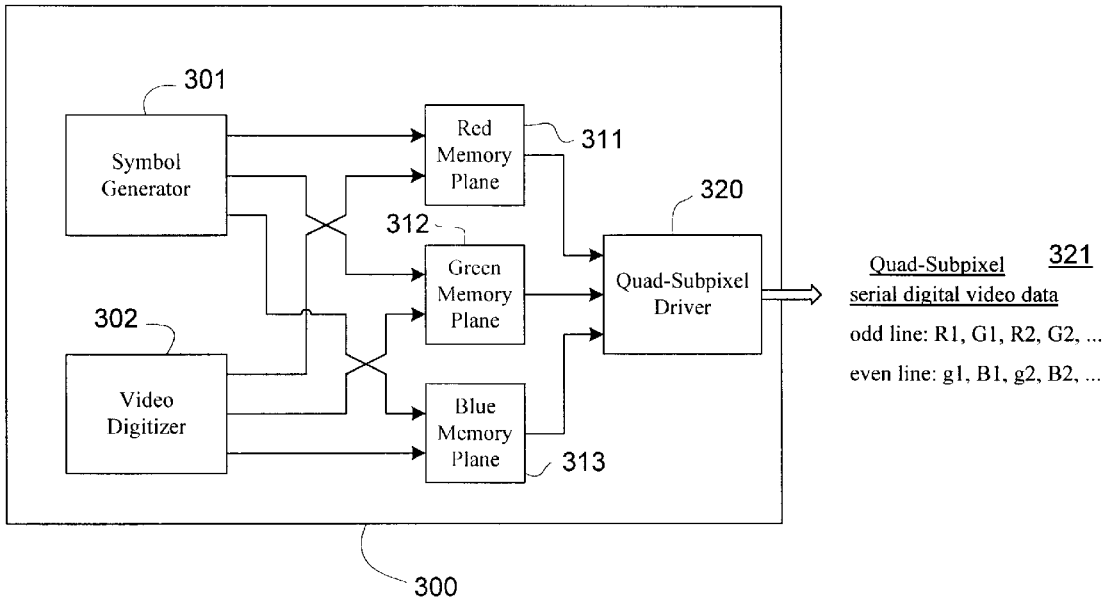
FIG. 3 (Prior Art)
FIG. 3 depicts an existing aircraft display processor designed to drive a quad-subpixel color display in accordance with the prior art.

Referring to FIG. 3, a block diagram of a typical display processor 300 that is used to drive a quad-subpixel color display 100 on board a vehicle such as an aircraft is shown. A symbol generator 301 creates graphical symbols in response to a series of commands. A video digitizer 302 processes an incoming video stream (not shown) into digital data, such as 32-bits per pixel with 8-bits per subpixel for a quad-subpixel display. Both the symbol generator 301 and the video digitizer 302 load digital data into an image memory, such as an image memory comprising a red memory plane 311, a green memory plane 312, and a blue memory plane 313. A quad-subpixel driver 320 fetches data from the image memory to produce a quad-subpixel digital data stream 321. A characteristic of the quad-subpixel digital data stream 321 is that it comprises odd and even line repeating data sequences. The odd lines may contain data for the red (R) subpixel 111 and the first green (G) subpixel 112 and the even lines may contain data for the second green (g) subpixel 114 and the blue (B) subpixel 113, as illustrated in FIG. 1.

Figure 4:
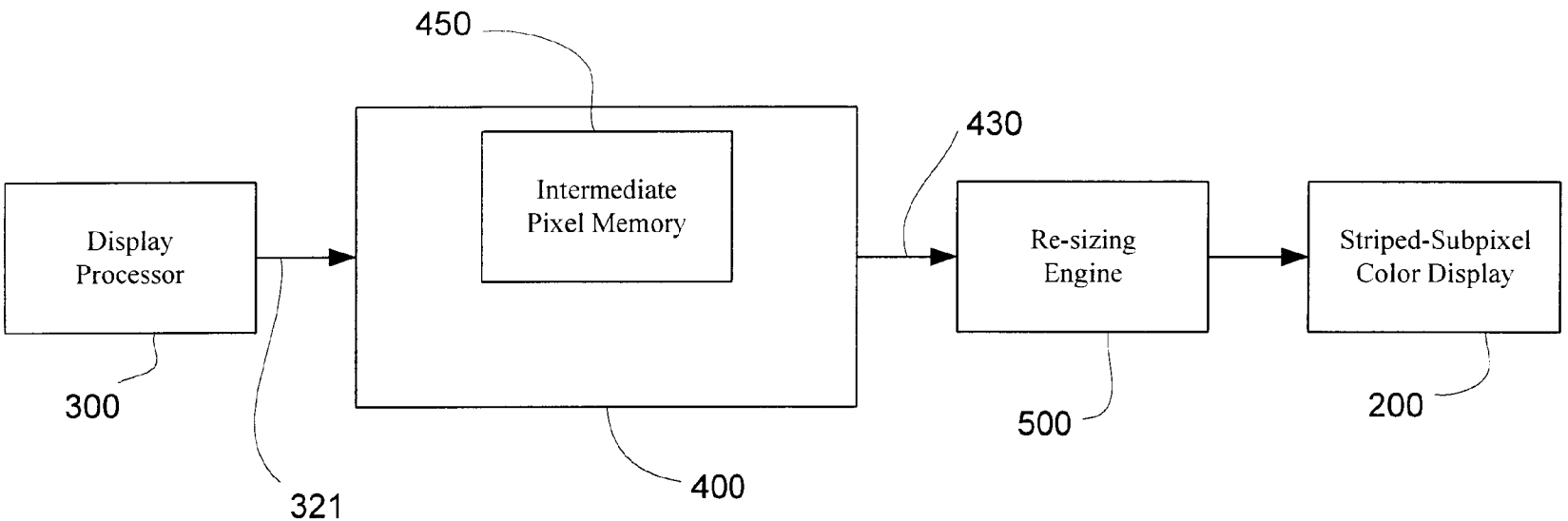
FIG. 4 is a schematic diagram of one illustrative embodiment of my invention utilizing the existing aircraft display as typified by FIG. 3 to drive a striped-subpixel color display.

Referring next to FIG. 4, in accordance with my invention, the output quad-subpixel digital data stream 321 from the aircraft display processor 300 is applied as an input to a processor 400 containing an intermediate pixel memory 450.

Figure 5:
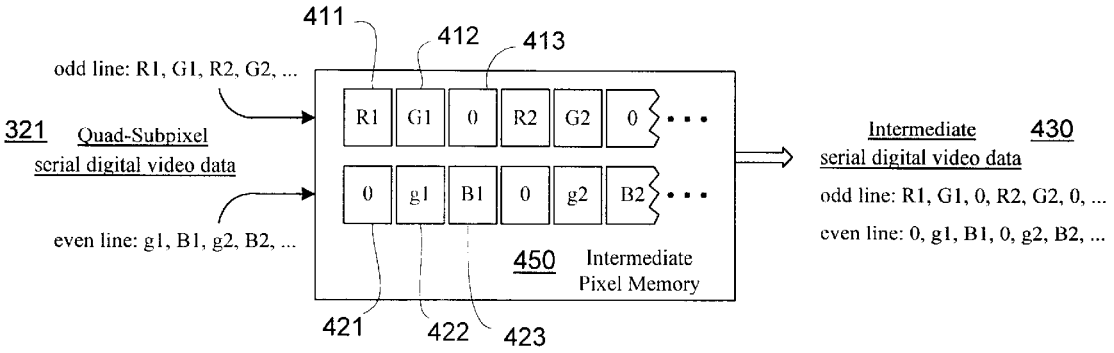
FIG. 5 depicts the contents of an intermediate pixel memory according to a first illustrative embodiment of my invention.

Within processor 400, a set of subpixel intensity information is extracted for each video line contained within the quad-subpixel digital data stream 321, representing an input video image and stored in memory 450. In one embodiment of my invention, as depicted in FIG. 5, each video line is comprised of an odd line and an even line, as follows.

1) The red subpixel at line x-coordinate=1 (R1) intensity data contained on an odd line within the quad-subpixel digital data stream 321 is mapped into a first odd line memory position 411 contained within the intermediate pixel memory 450.
2) The first green subpixel at line x-coordinate=1 (G1) intensity data contained on an odd line within the quad-subpixel digital data stream 321 is mapped into a second odd line memory position 412 contained within the intermediate pixel memory 450.
3) A digital value representing intensity=0 is loaded into a third odd line memory position 413 contained within the intermediate pixel memory 450.
4) The above steps 1–3 are repeated for the remaining red (R) and first green (G) subpixels at line x-coordinates>1 contained within the odd line within the quad-subpixel digital video stream 321 by loading the remaining subpixel data in the order: R, G, 0, into sequential memory positions contained within the intermediate pixel memory 450.
5) A digital value representing intensity=0 is loaded into a first even line memory position 421 contained within the intermediate pixel memory 450.
6) The second green subpixel at line x-coordinate=1 (g1) intensity data contained on an even line within the quad-subpixel digital data stream 321 is mapped into a second even line memory position 422 contained within the intermediate pixel memory 450.
7) The blue subpixel at line x-coordinate=1 (B1) intensity data contained on a even line within the quad-subpixel digital video stream 321 is mapped into a third even line memory position 423 contained within an intermediate pixel memory 450.
8) The above steps 5–7 are repeated for the remaining second green (g) and blue (B) subpixels at line x-coordinates>1 contained within the even line within the quad-subpixel digital data stream 321 by loading said remaining subpixel data in the order: 0, g, B, into sequential memory positions contained within the intermediate pixel memory 450.

The processor 400 produces an output intermediate digital data stream 430 using the subpixel intensity data contained within the intermediate pixel memory 450. A characteristic of the intermediate digital data stream 430 is that each odd line contains zero-intensity padding bits which could, for example, result in a subpixel bit sequence: R1, G1, 0, R2, G2, 0, . . . R512, G512, 0, for a 512×512 quad-subpixel display. A further characteristic of the intermediate digital data stream 430 is that each even line contains zero-intensity padding bits which could, for example, result in a subpixel bit sequence: 0, g1, B1, 0, g2, B2, . . . 0, g512, B512, for a 512×512 quad-subpixel display. A further characteristic of the intermediate digital data stream 430 is that the overall video image represented by the data stream is distorted in the horizontal direction, for example by being 133% wider than an undistorted input.

The intermediate digital data stream 430 is input into a display resizing engine 500, such as a Genesis® chip. The resizing engine can adjust the aspect ratio of the video image represented by the intermediate digital data stream 430 by scaling the horizontal and vertical dimensions of the video image independently of each other using techniques that are known in the art. In one embodiment of my invention, the distorted video image represented by the intermediate digital data stream 430 is undistorted by scaling the horizontal dimension only, for example by scaling to 66.6%. The undistorted video image is sent from the resizing engine 500 to a striped-subpixel color display 200.

In accordance with an aspect of my invention, the striped-subpixel color display 200 advantageously has a higher resolution than an original video image represented by the quad-subpixel digital data 321. The resizing engine 500 scales the vertical dimension according to a vertical resolution ratio between the striped-subpixel color display 200 and the original video image, for example $$\left(\frac{768}{512}\right).$$

The resizing engine 500 scales the horizontal dimension according to both a horizontal resolution ratio, between the striped-subpixel color display 200 and the original video image, and a distortion factor introduced by an aspect of my invention discussed previously, for example $$\left(\frac{768 * 1.33}{512}\right).$$

Figure 6:
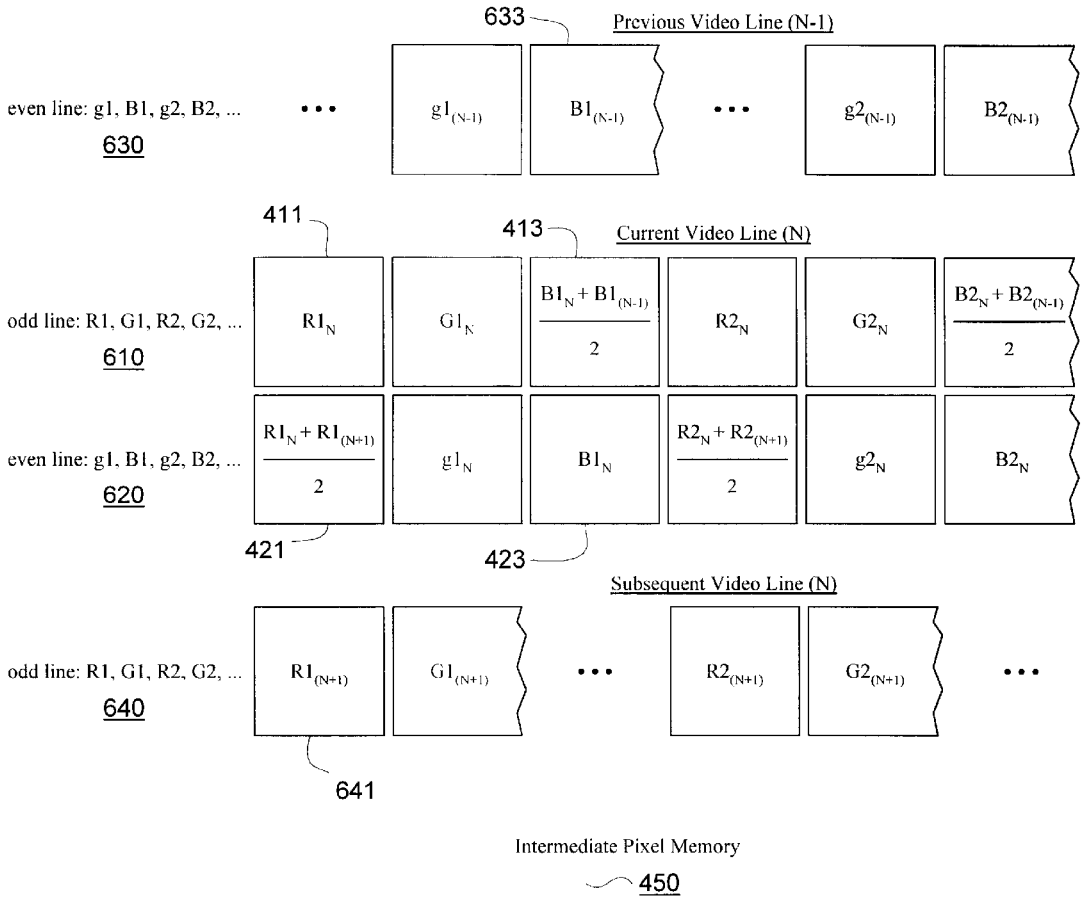
FIG. 6 depicts the contents of an intermediate pixel memory according to a second illustrative embodiment of my invention.

Referring next to FIG. 6, a further embodiment of my invention is illustrated wherein the extra padding values are average intensity values. Advantageously, in this embodiment, the processor 400 first produces within the intermediate pixel memory 450 the distorted intermediate digital data stream containing the padded extra data zero values and the replaces these zero values with padded data values having average intensity values. Accordingly, as in the previous embodiment, a set of subpixel intensity information is extracted for each video line contained within the quad-subpixel digital data stream 321 (shown in FIG. 4). In this embodiment, the quad-subpixel digital data stream 321 for a current video line (N) is subdivided into a current video odd line repeating data sequence 610 and a current video even line repeating data sequence 620. In a similar manner, the quad-subpixel digital data stream for a previous video line (N−1) is subdivided into a previous video odd line repeating data sequence and a previous video even line repeating data sequence 630. In addition, the quad-subpixel digital data stream for a subsequent video line (N+1) is similarly subdivided into a subsequent video odd line repeating data sequence 640 and a subsequent video even line repeating data sequence. In this embodiment, the set of subpixel intensity information contained within the intermediate pixel memory 450 is further processed as follows, before the production of the intermediate digital data stream 430. Starting at a second video line within the intermediate pixel memory 450 that represents the video input image and repeating for all subsequent lines, the steps listed below follow step No. 8 in the previous embodiment.

9) For line x-coordinate=1, an average blue video intensity between a current blue subpixel ($B1_N$), contained in the third even line memory position 423, and a previous blue subpixel ($B1_{(N-1)}$), contained in a first previous even line memory position 633 and sourced from a previous video even line repeating data sequence 630, is computed using the following equation:

$$\text{average blue video intensity} = \left(\frac{BI_N + BI_{(N-1)}}{2}\right).$$

10) The average blue video intensity is loaded into the third odd line memory position 413 overwriting the digital value contained therein.

11) The above steps 9–10 are repeated to calculate a set of remaining blue (B) subpixels at line x-coordinates>1 corresponding to the current video odd line repeating data sequence 610.

12) An average red video intensity between a current red subpixel ($R1_N$), contained in the first odd line memory position 411, and a subsequent red subpixel ($R1_{(N-1)}$), contained in a first subsequent odd line memory position 641 and sourced from a subsequent video odd line data stream 640, is computed using the following equation:

$$\text{average red video intensity} = \left(\frac{RI_N + RI_{(N+1)}}{2}\right).$$

13) The average red video intensity is loaded into the first even line memory position 421 overwriting the digital value contained therein.

14) The above steps 12–13 are repeated to calculate a set of remaining red (R) subpixels at line x-coordinates>1 corresponding to the current video even line data stream 620.

As in the previous embodiment, the processor 400 produces the intermediate digital data stream 430 using subpixel intensity data contained within the intermediate pixel memory 450. Advantageously, in this alternate embodiment, only three video lines consisting of a previous video line, a current video line, and a subsequent video line, are required to be buffered within the intermediate pixel memory 450.

Whereas the drawings and accompanying description have shown and described the preferred embodiment of the present invention, it should be apparent to those skilled in the art that various changes may be made in the form of the invention without affecting the scope thereof. Thus, in other embodiments of my invention, various other values may be utilized for the padded extra data values.

What is claimed is:

1. An apparatus for driving a striped-subpixel color display from a quad-subpixel data stream, said apparatus comprising:

an input for accepting said quad-subpixel digital data stream that represents an input video image comprising color subpixel intensity data, said quad-subpixel digital data stream including a plurality of odd line data and a plurality of even line data;

a processor for receiving said quad-subpixel digital data stream from said input, said processor including an intermediate pixel memory and producing an output intermediate digital data stream that represents a distorted video image comprising color subpixel intensity data, said intermediate digital data stream including a plurality of odd line data including padding data values and a plurality of even line data including padding data values; and a resizing engine for undistorting said output intermediate digital data stream and applying an output digital data stream to the striped-subpixel color display.

2. The apparatus in accordance with claim 1, wherein said padding values have zero values.

3. The apparatus in accordance with claim 1, wherein said padding values have average color intensity values.

4. An apparatus for remapping subpixels for a color display comprising:

an input for accepting a quad-subpixel digital data stream that represents an input video image comprising color subpixel intensity data, said quad-subpixel digital data stream including, a plurality of odd line data, and a plurality of even line data, with said even line data alternating with said odd line data;

a processor for receiving said quad-subpixel digital data stream from said input, said processor including an intermediate pixel memory containing, a plurality of odd line memory positions arranged in a repeating sequential order including a first odd line memory position, a second odd line memory position, and a third odd line memory position, and a plurality of even line memory positions arranged in a repeating sequential order including a first even line memory position, a second even line memory position, and a third even line memory position;

said processor producing an output intermediate digital data stream that represents a distorted video image comprising color subpixel intensity data, said intermediate digital data stream including, a plurality of odd line data including a plurality of padding data values, said odd line data being sourced from said odd line memory positions, and a plurality of even line data including a plurality of padding data values, said even line data being sourced from said even line memory positions, and with said even line data alternating with said odd line data within said output intermediate digital data stream; and a resizing engine for undistorting said output intermediate digital data stream and applying an output digital data stream to a striped-subpixel color display.

5. The apparatus in accordance with claim 4, wherein said padding values have a zero value.

6. The apparatus in accordance with claim 4, wherein said padding values have an average color intensity values.

7. The apparatus in accordance with claim 4, wherein said processor first produces padding values of zero value and then replaces them with padding values of average color intensity.

8. The apparatus of claim 4, wherein said striped-subpixel color display has a higher resolution than the input video image.

9. The apparatus of claim 8, wherein a ratio between the resolution of said striped-subpixel color display to the resolution of said input video image is 768:512.

10. A method for applying a quad-subpixel digital data stream to a striped-subpixel color display, wherein said quad-subpixel digital data stream includes a plurality of odd line repeating data sequences further including a red subpixel followed by a first green subpixel and a plurality of even line repeating data sequences further including a second green subpixel followed by a blue subpixel, said method comprising the steps of:

mapping each of said red subpixels of said odd line repeating data sequences into a first odd line memory position contained within a repeating sequence of three odd line memory positions;

mapping each of said first green subpixels of said odd line repeating data sequences into a second odd line memory position contained within said repeating sequence of three odd line memory positions;

loading a digital value representing zero intensity into a third odd line memory position contained within said repeating sequence of three odd line memory positions;

loading a digital value representing zero intensity into a first even line memory position contained within a repeating sequence of three even line memory positions;

mapping each of said second green subpixels of said odd line repeating data sequences into a second even line memory position contained within said repeating sequence of three even line memory positions;

mapping each of said blue subpixels of said odd line repeating data sequences into a third even line memory position contained within said repeating sequence of three even line memory positions;

outputting the contents of said repeating sequence of three odd line memory positions said repeating sequence of three even line memory positions as an intermediate digital data stream into a resizing engine;

undistorting a video image represented by said intermediate digital data stream by adjusting the aspect ratio thereof; and driving a striped-subpixel color display with an output from the resizing engine.

11. The method of claim 10 wherein said repeating sequence of three odd line memory positions and said repeating sequence of three even line memory positions are contained within an intermediate pixel memory.

12. The method of claim 11, wherein the video image represented by said intermediate digital data stream is undistorted by scaling a horizontal dimension of said video image to 66%.

13. The method of claim 10, further comprising the step of:

scaling the video image represented by said intermediate digital data stream by a horizontal scale factor and a vertical scale factor dimension.

14. The method of claim 13, wherein said horizontal scale factor is 768:512 and said vertical scale factor is 768:512.

15. A method for applying a quad-subpixel digital data stream to a striped-subpixel color display, wherein said quad-subpixel digital data stream includes a plurality of odd line repeating data sequences comprising a red subpixel followed by a first green subpixel and a plurality of even line repeating data sequences comprising a second green subpixel followed by a blue subpixel, said method comprising the steps of:

mapping each of said red subpixels of said odd line repeating data sequences into a first odd line memory position contained within a repeating sequence of three odd line memory positions;

mapping each of said first green subpixels of said odd line repeating data sequences into a second odd line memory position contained within said repeating sequence of three odd line memory positions;

loading a digital value representing an average blue intensity into a third odd line memory position contained within said repeating sequence of three odd line memory positions, said average blue intensity computed from a blue subpixel of said even line repeating data sequences and a blue subpixel of a previous even line repeating data sequence;

loading a digital value representing an average red intensity into a first even line memory position contained within a repeating sequence of three even line memory positions, said average red intensity computed from a red subpixel of said odd line repeating data sequences and a red subpixel of a subsequent odd line repeating data sequence;

mapping each of said second green subpixels of said odd line repeating data sequences into a second even line memory position contained within said repeating sequence of three even line memory positions;

mapping each of said blue subpixels of said odd line repeating data sequences into a third even line memory position contained within said repeating sequence of three even line memory positions;

outputting the contents of said repeating sequence of three odd line memory positions said repeating sequence of three even line memory positions as an intermediate digital data stream into a resizing engine;

undistorting a video image represented by said intermediate digital data stream by adjusting the aspect ratio thereof; and driving a striped-subpixel color display with an output from the resizing engine.

16. The method of claim 15 wherein said repeating sequence of three odd line memory positions and said repeating sequence of three even line memory positions are contained within an intermediate pixel memory.

17. The method of claim 15, wherein the video image represented by said intermediate digital data stream is undistorted by scaling a horizontal dimension of said video image to 66%.

18. The method of claim 15, further comprising the step of:

scaling the video image represented by said intermediate digital data stream by a horizontal scale factor and a vertical scale factor dimension.

19. The method of claim 18, wherein said horizontal scale factor is 768:512 and said vertical scale factor is 768:512.

20. A method for driving a striped-subpixel color display from a quad-subpixel data stream, said method comprising the steps of:

producing from said quad-subpixel data stream a distorted intermediate digital data stream comprising color subpixel intensity data and including padding data values;

undistorting said intermediate digital data stream to produce an output digital data stream; and applying said output digital data stream to a striped-subpixel color display.

21. The method in accordance with claim 20, wherein said padding values have zero value.

22. The method in accordance with claim 20, wherein said padding values have average color intensity values.

* * * * *